US006497586B1

(12) United States Patent
Wilson

(10) Patent No.: US 6,497,586 B1
(45) Date of Patent: Dec. 24, 2002

(54) STRUCTURAL TRUSS SYSTEM WITH ADJUSTABLE MECHANICAL MOUNTING TRACK AND INTERNAL CONDUIT ACCESSIBLE FROM REMOVABLE SIDEWALL

(76) Inventor: Steven W. Wilson, P.O. Box 504, Redwood Valley, CA (US) 95470

( * ) Notice: Subject to any disclaimer, the term of this patent is extended or adjusted under 35 U.S.C. 154(b) by 0 days.

(21) Appl. No.: 09/717,514

(22) Filed: Nov. 20, 2000

Related U.S. Application Data

(60) Provisional application No. 60/166,586, filed on Nov. 19, 1999.

(51) Int. Cl.[7] ..... H01R 13/627

(52) U.S. Cl. ..... 439/532; 439/114; 362/383

(58) Field of Search ..... 439/532, 110, 439/111, 112, 113, 114, 115, 116; 362/383, 384

(56) References Cited

U.S. PATENT DOCUMENTS 2,384,487 A * 9/1945 O'Brien ..... 439/216
5,259,774 A * 11/1993 Gabrius ..... 439/110
5,647,763 A * 7/1997 Arnold et al. ..... 439/540
5,772,315 A * 6/1998 Shen ..... 362/396
6,000,694 A * 12/1999 Jaag ..... 439/532
6,059,582 A * 5/2000 Tsai ..... 439/121

* cited by examiner

*Primary Examiner*—P. Austin Bradley
*Assistant Examiner*—Truc Nguyen
(74) *Attorney, Agent, or Firm*—Donn K. Harms

(57) ABSTRACT

A structural truss system and electrical conduit for suspended mounting of electrical components such as stage lighting and remote controlled equipment featuring an elongated support beam with removable endcaps and a sidewall. The sidewall is cooperatively engageable with the support beam along substantially its engire length and allows access to the conduit formed inside when engaged with the support beam. A mounting track formed on the exterior surface of said bottom wall of the support beam and provides a slidably engageable mount for component mounts that attach to electrical components such as lights thereby providing positioning ability for the attached components. One or a plurality of electrical plugs or similiar attachments communicate through the sidewalls with wires running in the conduit and allow the electrical components to be properly situated in the mounting track and then plugged into the electrical power or control signals provided by the internal wiring.

9 Claims, 2 Drawing Sheets

STRUCTURAL TRUSS SYSTEM WITH ADJUSTABLE MECHANICAL MOUNTING TRACK AND INTERNAL CONDUIT ACCESSIBLE FROM REMOVABLE SIDEWALL

This application claims the benefit of application no. 60/166,586 filed Nov. 19, 1999.

BACKGROUND OF THE INVENTION

1. Field of the Invention

The present invention relates to support members used for attachment of lighting and electrical components. More particularly it relates to a structural truss device for use in construction of theatrical lighting and mounting of electrical components such as spotlights, and speakers, over stages used by entertainers. The device provides a combination of an enclosed conduit for routing electrical wires and control wires protected from external harm while inside the interior cavity. The device further provides a track for the adjustable mounting of lights and other heavy stage electrical equipment therefrom along with and a removable sidewall which provides access to the wires communicating through the enclosed conduit. Optional compression bolts may be used to increase compaction on the sidewall in its mountings and to also allow for mounting to support structures or wires if desired.

2. Prior Art

Modern stage productions frequently involve the necessity of overhead lights, sound system equipment, and other electronic equipment used during the production on the stage. With the advent of modern traveling rock bands and theater productions, the stages used for the production in question frequently moves from city to city on a weekly if not daily basis. Consequently the components used for installation of light and sound and other electronic equipment for such productions must provide for easy installation, removal, and reinstallation at frequently changing venues. Even productions that are static in that they do not move still require the installation of many overhead lights and other electrical equipment necessary for a modern theatrical production.

Currently, the installation of lights and sound equipment above stages is accomplished by the mounting of trusses which traverse the stage and are supported by end posts and cables and other conventional manner. The beams used for this type of support generally are round and of a length sufficient to traverse the distance required. The lighting or speakers or other equipment suspended from the beams are generally bolted to the exterior or attached using compression clamps or similar compression type fittings that grip the exterior surface of the support beam.

Since electric components require wires to power them and to control any remote movement aspects such as motors to change the direction of attached spotlights, this wiring must also communicate between the attached components and the power source or remote control device that controls their movement. This wiring is conventionally attached at the exterior of the support beam using plastic ties or rope or other manner to hold the wires to the support beam and out of the viewing area of the stage.

A number of problems arise in this mode of construction and wiring for the heavy devices such as spotlights and speakers used on a modern stage. First, the wiring being mounted on the outside of the support structure is subject to constant damage from abrasion from heavy poles adjacent to the support beam. Further, on stages designed for rapid deployment in venues in different cities, the constant removal and reinstallation of the wires in this manner subjects them to constant risk of damage from abrasion and impact during construction and removal of the stage structure.

Further, problems arise in the mounting of the heavy lighting and sound equipment from the support beams. Generally such heavy components are attached to the support beams using compression fittings such as "C" clamps that grip the support beam and must be tightened to a point that the clamp will not slide or rotate on the support. If the clamp loosens from vibration the light or speaker or other device will become disoriented from its intended direction. Also, the very nature of the intense compression needed to insure a firm mount to the support beam exterior also insures a hard time uninstalling the component due to the force needed to decompress the fitting on the structure. Such a compression mounting also causes delays in the installation of the equipment on new venues due to the time involved in mechanically turning the compression screws or other devices required to achieve a safe and secure mount above the performers.

Additional concerns arise with the connection point of the electrical device to the communicated power source or control device. Generally the high current draw of spotlights require thick wiring for supply and communication of a high amperage power supply to the light. Most such wires terminate at a pin connector which has male and female components to allow connection and disconnection of the light or speaker or other component from the wiring supplying it. These pin connectors are also subject to damage during installation on stage structures that are constantly being installed and dismantled. Further, they are subject to disconnection if the communicating components of the pin connectors are not properly mated and held together during installation.

As such, a need is ever present for an easily installed system of overhead support structures for stage lighting, speakers, and other electrical components mounted overhead in modern stage productions such as rock concerts and plays. Such a system should allow for easy assembly and disassembly for shows that travel to new venues on a constant basis. Such a system should also provide protection from damage to the electrical cables supplying the mounted components. Finally such a system needs to provide a very secure mount to the heavy components mounted upon it, while concurrently providing an easy manner to achieve that mount and to adjust that mount if needed. Additional utility from such a system would be provided by the ability to pre configure the support structure to individual stage construction and thereafter allow very fast installation of the wiring and components using the pre configured support beams and internally mounted wiring and pin connections.

U.S. Pat. No. 5,672,003 (Shemitz) addresses a universal track mounting system to provide modular construction, however Shemitz does not provide for an easy mount of components on the support structure since in requires a clamp clamps about the entire structure. Further Shemiz makes no provision for the large wiring required by high current drawing stage lighting and similar components and access to such wiring during installation or prefabrication.

U.S. Pat. No. 5,772,315 (Shen) teaches a structure for clamping of lamps to a support that provides a track for power to the lights however Shen does not provide for the many varying types of speakers, spotlights, and remote control wiring that must be individually communicated to the many components mounted to a stage support truss. Neither does it provide any easy manner to access that wiring if needed.

As such, there exists a need for an easily and inexpensively manufactured system of components that may be readily assembled into a stage lighting and sound system over a stage production. Such a system would provide a protected conduit for the individual control and power supply cables that must communicate with each individually supported lighting, sound, or other device attached to support members. Such a system would provide easy access to the conduit while concurrently providing the weight bearing attributes of the support beam to carry the heavy components used for stage productions. Further such a system would provide for easy assembly and disassembly of the stage lighting and sound systems for productions that change venue frequently, or stages that change shows frequently and thereby require different structures for the different shows being shown on the stage at different times.

SUMMARY OF THE INVENTION

Applicants' device is an easily configured and installed system for structural truss system for providing an adjustable mechanical mount using a track for the heavy lighting, sound, and other components used overhead in stage productions.

The system features a track formed upon the lower surface of a support beam which allows for easy attachment of a mount for a spotlight or speaker or other component to any number of positions on the track. The mounting is achieved by insertion of a cooperatively engaging track mount onto the track and sliding it to the proper location for the component being mounted. Once so placed, the track mount is secured in place by a quick compression of a fitting upon the track. Since the track mount is supported by the track and not the compression upon the beam of a clamp or other mounting component, little compression is needed to secure the component in place and there is no danger of heavy components falling if compression on the fitting is not tight.

The wiring providing electrical current to the mounted devices such as spotlights, speakers, amplifiers, and the like is run through a conduit formed on the interior of the support beam. By running the power and control wires through the conduit formed internally in the support beam, the wiring is protected from abrasion and other damage during the installation of the heavy components used in stage productions. It is also protected from others on the stage or set that might be installing equipment that could brush against the support beam and cause damage to the wires.

If the support beams are prefabricated to the individual requirements of the show being staged, the wires placed in the conduit may remain sealed safely therein during installation, disassembly, and transport. This function is provided by the provision of pin connectors or other means of electrical connection of the internal wiring to external power or control panels. By placing pin connectors in a removable side panel so that a face with pin connectors is communicated through the side wall, a mating pin connector may be attached. In this way the wiring placed inside the conduit may be attached at both ends to connectors that will mount to the sidewall and communicate the circuit through the sidewall to a face plate with pin connectors therein. When installed on a set or stage, the pin connectors provide both a connection point to the power and control panels and the cables inside the conduit, and, a connection point at the other end of the cables to the light, speaker, or other component that must communicate with the respective power source or control unit attached at the other.

When installing or disassembling a stage setup, the support beam thus is attached at its ends to support structures, the components mounted to the track in the appropriate placement, and the wiring to the components connected using the pin connectors or other cooperative connecters communicating through the removable sidewall at both ends of the cables.

Another object of this invention is to provide an easily assembled and disassembled support system for stage components such as lighting and speakers.

A further object of this invention is the provision of adjustable mounting of the components in a support track that provides a safe and secure mount of the heavy components over the stage.

An additional object of this invention is providing a conduit to protect the supply and control cables which communicate with the components mounted in the support track.

A still further object of this invention is provided by the ability to preassemble the support beams to the dimensions of the stage for easy and fast installation and removal while still providing a secure mount to the components and protection to the wiring in a conduit.

Further objects of the invention will be brought out in the following part of the specification, wherein detailed description is for the purpose of fully disclosing the invention without placing limitations thereon.

BRIEF DESCRIPTION OF DRAWING FIGURES

DETAILED DESCRIPTION OF THE PREFERRED EMBODIMENTS OF THE INVENTION

Figure 1:
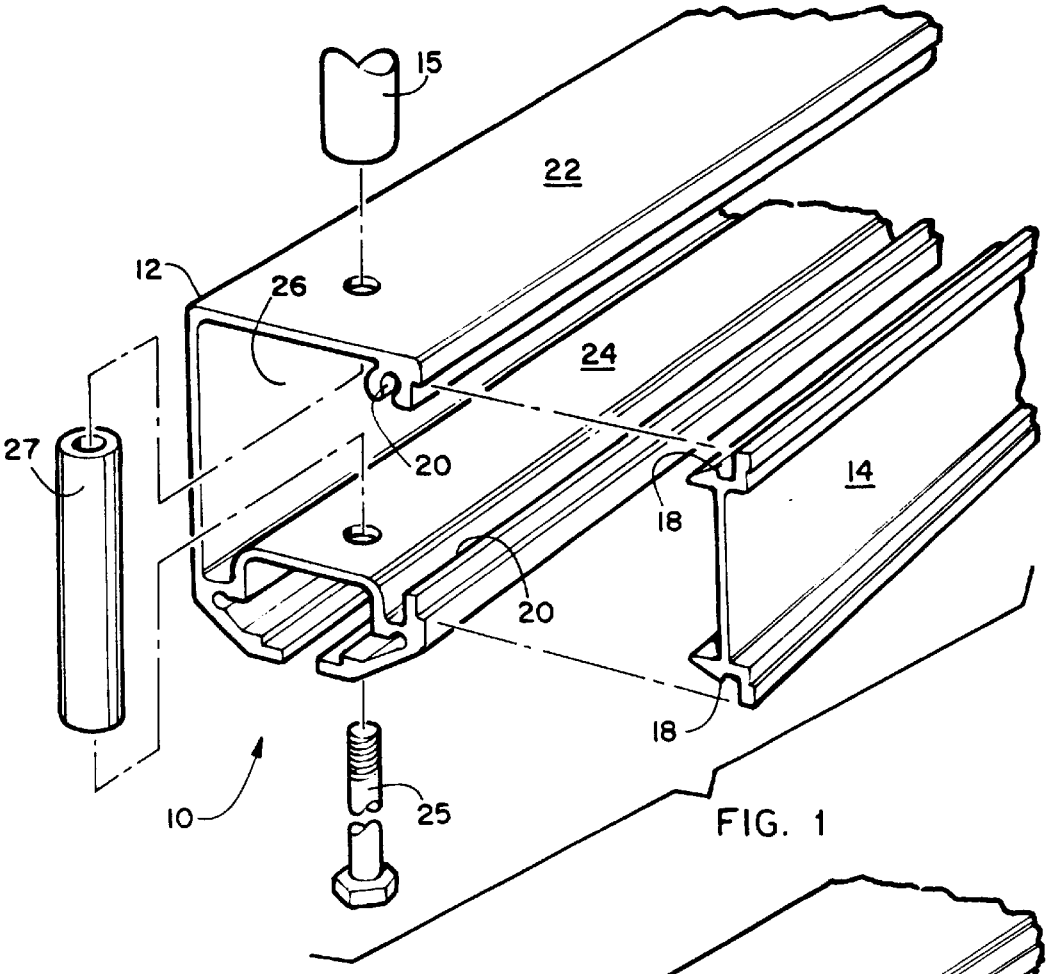
FIG. 1 is a perspective view showing the support beam with removably mountable sidewall providing in a dismounted position to access to an internal conduit.
Figure 2:
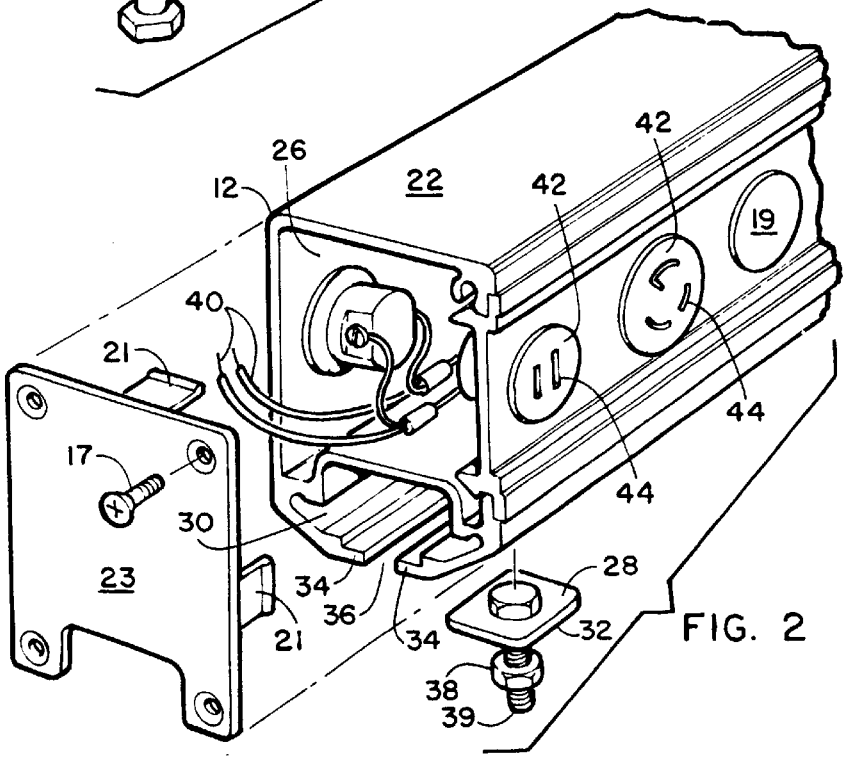
FIG. 2 is a perspective view of the support beam showing the removably mountable sidewall mounted into cooperatively engageable tongue and groove type channels on both the sidewall and the beam.
Figure 3:
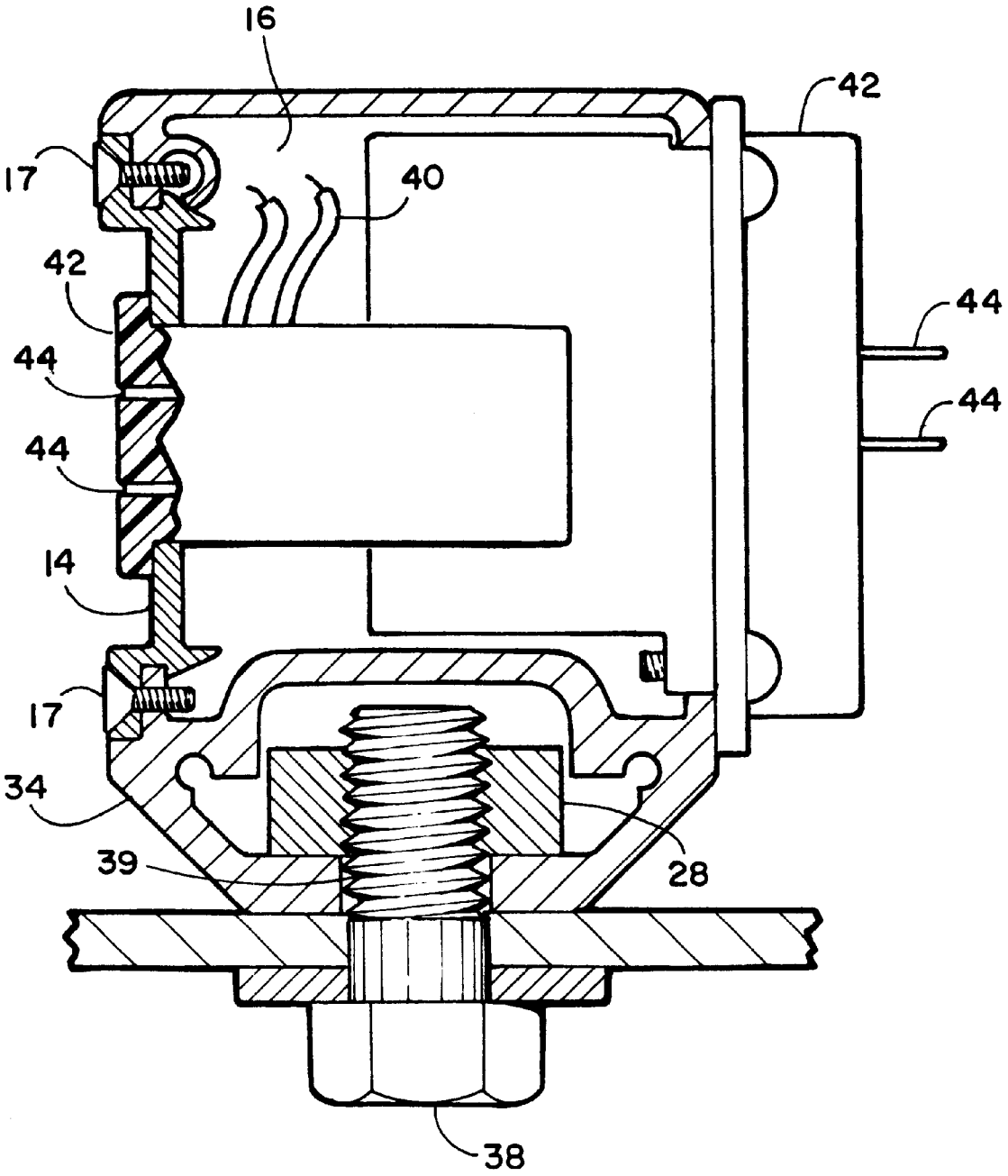
FIG. 3 is an end view of the support beam showing pin connectors communicating through the removable sidewall and the opposite sidewall for communicating with the internal wiring.

Referring now to the drawing Figures, specifically FIGS. 1 through 3 depict preferred embodiments of the device herein disclosed with the various components thereof in operative positions. FIG. 1 depicts the device 10 in a perspective end view of the support beam 12 showing the removably mountable sidewall 14 dismounted from the support beam 12. This removable mounting ability provides the user with the ability to remove the sidewall 14 to place, remove, or otherwise service wiring that may be carried in the conduit 16 formed on the interior of the support beam 12.

The sidewall 14 is secured by a means of cooperative engagement of the sidewall 14 to the support beam 12 which in this case is shoulders 18 which cooperatively engage slots 20 formed into the support beam 12. The shoulders 18 run the entire length of the sidewall 14 and cooperatively engage the slots 20 which are operatively placed along the support beam 12 parallel to the center axis of the support beam 12.

Optionally, screws 15 or other fasteners might also be used in combination with the shoulders 18 and slots 20 if an especially secure mount is desired.

The support beam 12 forms a "C" shape with the sidewall 14 removed providing and open side and communication to the conduit 16 which runs the length of the support beam 12 along the center axis thereof. The support beam is manufacture in the current best mode by extrusion out of material such as aluminum or alloys thereof to provide for easy manufacture and strength. When so extruded, if a slight biasing of the top wall 22 toward the bottom wall 24 may be provided by making the dye used for the extrusion to provide a slight inward slant of one or both of the top wall 22 and bottom wall 24 toward the center axis of the support beam 12. This bias provides a very secure fit between the cooperatively engaging shoulders 18 and slots 20 when the sidewall 14 is mounted to the support beam 12 and allows a means for compression of the top wall 22 toward the bottom wall 24 and resulting communicating compression on the shoulders 18 and slots 20 thereby providing an especially secure removable mounting of the sidewall 14 to the support beam 12 when installed. Of course other means of cooperative engagement of the ends of the sidewall 14 with the support beam 12 might be used other than the shoulder 18 and slot 20 as depicted in the current best mode and such means of cooperative engagement are anticipated.

Another optional manner to bias the top wall 22 and bottom wall 24 inward toward the center axis would be the optional use of compression bolts 25 which would threadably engage the top wall 22 by turning the head of the bolt 25 which engages the bottom wall 24. A sleeve 27 would around the bolt 25 would stop the compression of the top wall 22 and bottom wall 24 toward the center axis once compression caused by threading the bolt 25 into the top wall 22 causes the bottom wall 24 and top wall 22 to contact the sleeve 27. Thus the sleeve length would determine the amount of compression. The bolt 25 where it communicates through a threaded hole in the top wall 22 could also act as a mount for the support beam 12 between its two ends. The mount could be attached to a properly configure cable 15 or other support to provide additional support to the beam 12 at various points.

A mounting track 26 is provided on the exterior bottom wall 24 for the mounting of a cooperatively engageable component mount 28 which slidably engages the mounting track 26 by placement through a track aperture 30 and onto the track. Shoulders 32 on the component mount 32 are configured to be supported by the struts 34 which are situated along parallel to the center axis of the support beam 12 opposite a slot 36. A mounting nut 38 can then be tightened upon a mounting bolt 39 to contact the shoulders 32 and tighten the mount 28 in the track 26 by frictional engagement caused by compression. Since the shoulders 32 support the component weight by bearing on the track struts 34, very little compression of the nut 38 is required to hold the component mount 28 in proper position and any heavy attached component safely in place. As is obvious to those skilled in the art, other means for mounting components to the support beam might be used to obtain an exterior mount to the support beam 12 and such are anticipated, however the current best means of mounting of the components to the support beam 12 is the track 26 and cooperatively engageable component mount 28.

Additionally, the provision of the two track struts 34 provide additional structural support to the support beam 12 by doubling as additional supports to the bottom wall 24 and provide the ability for the support beam 12 to carry more of a load.

As noted, the conduit 16 formed on the interior of the support beam 12 provides a path for wires 40 to be communicated to the components hanging from the support beam 12 over a stage. While a simple aperture in the sidewall 14 or opposite support wall 15 will provide a path for such wires 40 to communicate into and out of the conduit 16 to the control box or the hanging components, the current best mode uses conventional pin connectors 42 to communicate between the wires placed inside the conduit 16 and components or controls that must be attached to the wires 40 outside the conduit. Such pin connectors have cooperatively engageable pins 44 generally mounted in an insulating material portion of the pin connector 42. The pin connectors 42 communicate through the sidewall 14 or the opposite support wall 15 or both through appropriately sized apertures in one or both wall. Thus, to connect exterior wires to the wires in the conduit 40 a pin connecter configured to mate to the mounted pin connector 42 would be used.

Using this pin connector 42 scheme, the device can be pre-configured to individual stages or pre-fabricated for remote installation with the most efficiency. In such a pre configuration, the pin connectors 42 for power sources or control motors or other reasons would attach to the interior wires 40 at an appropriate position on the support beam 12. The wires would run through the conduit 16 to a point in the sidewall 14 or opposite wall 15 adjacent to where a component is to be mounted and terminate at a second pin connector 42 which communicates the wires to the exterior of the support beam 12 in an insulated fashion. The component would thereafter be attached using a mating pin connector 42 which plugs into the properly placed pin connector 42 in the sidewall 14 or opposite support wall 15.

When so configured, the support beam 14 with properly placed pin connectors 42 and interior wiring 40 communicating between the control and component ends of the wires 40 can be made as a unit away from the stage site. Installation time is considerbly reduced since thee support beam 12 is installed pre wired and the components attached using the component mounts 28 to the track 26. The control and power sources would then be connected to the appropriate pin connectors 42 at one end of the support beam 12 and the components plugged into the communicating pin connecter 42 located adjacent to the component.

This allows the overhead components, speakers, lights, and the like to be installed in a very secure fashion in greatly reduced time frames from the conventional manner hanging and tying wires to beams and compression mounting heavy components to the same beams. Further, safety is greatly enhanced by the provision of the shoulders 32 supported by the struts 34 and no need for the dangerous clamp mounting of heavy components which will harm or injure performers if they fall. Further, once installed, the device 10 protects the wiring 40 from harm from abrasion and contact with later mounted components by others.

Removal and reinstallation times are significantly reduced by the use of the device 10 since the components are quickly dismounted from track 26 and from the electrical system by disconnection of the pin connectors 42. There is no need for the time consuming job of decompression of clamp mounts, and cutting exterior wiring from the support strut since all the wiring is internal and communicating through the cooperatively engageable pin connectors 42. Reinstallation times are thus shortened since the device 10 is quickly dismantled and shipped to the next staged event and quickly installed in the same fashion.

Additionally, by using the removably mountable sidewall 14, alterations of wiring and components mounted to the support beam 12 are easily accomplished while the device is installed above a stage. The sidewall 14 may be easily removed by pulling or prying it away from the compressed contact with the support beam 12 at the engagement of the shoulders 18 and slots 20. While off, the wiring may be changed or added to the conduit 16 and new pin connectors m42 may be added to the sidewall 14 by cutting the appropriate aperture therein or by removal of slugs 19 that are compression fit in to pre-cut apertures in the sidewall 14 or opposite wall 15 and placing the pin connector 42 therein. The sidewall 14 is then reattached to the support beam 12 by applying pressure to the sidewall 14 to forced the be provided by an endcap 23 which will cover the open ends of the conduit 16 using screws 17 or frictionally engaging pins 21 to frictionally engage the interior walls of the conduit 16. This endcap might also have pin connecters 42 communicating through it for communication with interior wires 40 should such be required.

While all of the fundamental characteristics and features of the Structural Truss System with adjustable mechanical mounting track and internal conduit accessible from a removable sidewall herein disclosed have been shown and described, it should be understood that various substitutions, modifications, and variations may be made by those skilled in the art without departing from the spirit or scope of the invention. Consequently, all such modifications and variations are included within the scope of the invention as defined by the following claims.

What is claimed is:

1. A structural truss system and electrical conduit for suspending mounting of electrical components comprising:

an elongated support beam, said support beam having a center axis, and a top wall and a bottom wall each connected at a first edge to a support sidewall and each having a distal edge opposite said first edge;

endcaps attachable to each of two ends of said support beam;

a sidewall having an upper edge and a lower edge;

means of cooperative engagement of said upper edge and said lower edge of said removable sidewall with said distal edge of said top wall and said bottom wall, along substantially the entire length of said support beam;

an enclosed conduit formed along said renter axis inside said support beam when said support beam is cooperatively engaged with said removable sidewall, said conduit providing a path for wires placed therein;

a mounting track formed on the exterior surface of said bottom wall, said mounting track having at least one aperture at a side edge of said bottom wall below a bottom edge of said endcaps, said aperture providing access to said mounting track for a slidably engageable component mount;

means to communicate electrical power in said wires to an electrical component attached to said component mount;

said top wall and said bottom wall attached to said support sidewall at an angle toward each other thereby causing a biased engagement of said upper edge and said lower edge of said sidewall with said distal edge of said top wall and said distal edge said bottom, wall when said sidewall is engaged with said support beam; and whereby said support beam when in a suspended position over a stage or similar venue, provides both a support for said electrical component and a conduit for the electrical supply or control wires for said electrical component and said removable sidewall is removable to provide access to said conduit while said support beam and said electrical component remain attached and in said suspended position.

2. The structural truss system as described in claim 1 wherein said means of cooperative engagement of said upper edge and said lower edge of said removable sidewall with said distal edge of said top wall and said bottom wall, along substantially the entire length of said support beam comprises;

a first slot formed at the distal end of said top wall and a second slot formed at the distal end of said bottom wall;

a first shoulder portion formed at said upper edge of said removable sidewall and a second shoulder portion formed at said lower edge of said removable sidewall; and said first shoulder portion cooperatively engageable with said first slot and said second shoulder portion cooperatively engageable with said second slot whereby said removable sidewall may be cooperatively engaged with said support beam along substantially the entire length of said support beam.

3. The structural truss system as described in claim 1 wherein said means to communicate electrical power in said wires to an electrical component attached to said component mount are comprised of at least one pin connector, said pin connector connected to said wires in said conduit and mounted in an aperture formed in said support sidewall or said removable sidewall, said pin connector engageable with a mating end of an electrical lead communicating with an attached electrical component.

4. The structural truss system as described in claim 1 wherein said mounting track is comprised of a pair of struts attached to said bottom wall and angling inward toward said center axis said struts having a gap therebetween forming a slot;

a center cavity between said bottom wall and said struts;

said component mount having a pair of shoulders attached to a mounting bolt said shoulders sized to slidably engage said struts in said center cavity;

said mounting bolt sized to freely slide in said slot whereby an electrical component attached to said mounting bolt may be positioned by sliding said component mount on its sliding engagement with said shoulders and said struts to an infinite number of positions in said mounting track between said endcaps, and said mating end of said electrical lead attached to said electrical component may be attached to one of a plurality of said pin connectors situated in said support sidewall or said removable sidewall.

5. The structural truss system as described in claim 2 wherein said mounting track is comprised of a pair of struts attached to said bottom wall and angling inward toward said center axis said struts having a gap therebetween forming a slot;

a center cavity between said bottom wall and said struts;

said component mount having a pair of shoulders attached to a mounting bolt said shoulders sized to slidably engage said struts in said center cavity;

said mounting bolt sized to freely slide in said slot whereby an electrical component attached to said mounting bolt may be positioned by sliding said component mount on its sliding engagement with said shoulders and said struts to an infinite number of positions in said mounting track between said endcaps, and said mating end of said electrical lead attached to said electrical component may be attached to one of a plurality of said pin connectors situated in said support sidewall or said removable sidewall.

6. The structural truss system as described in claim 4 in a kit form wherein a plurality of electrical components may be slidably attached to said mounting track using a plurality of differently configured component mounts, each of said plurality of component mounts having a mounting bolt configured at one end for cooperative engagement with the desired electrical component and at the other for shouldered engagement with said mounting track.

7. The structural truss system as described in claim 5 in a kit form wherein a plurality of electrical components may be slidably attached to said mounting track using a plurality of differently configured component mounts, each of said plurality of component mounts having a mounting bolt configured at one end for cooperative engagement with the desired electrical component and at the other for shouldered engagement with said mounting track.

8. A structural truss system and electrical conduit for suspending mounting of electrical components comprising:

an elongated support beam, said support beam having a center axis, and a top wall and a bottom wall each connected at a first edge to a support sidewall and each having a distal edge opposite said first edge;

endcaps attachable to each of two ends of said support beam;

a sidewall having an upper edge and a lower edge;

means of cooperative engagement of said upper edge and said lower edge of said removable sidewall with said distal edge of said top wall and said bottom wall, along substantially the entire length of said support beam;

an enclosed conduit formed along said center axis inside said support beam when said support beam is cooperatively engaged with said removable sidewall, said conduit providing a path for wires placed therein;

a mounting track formed on the exterior surface of said bottom wall, said mounting track having at least one aperture at a side edge of said bottom wall below a bottom edge of said endcaps, said aperture providing access to said mounting track for a slidably engageable component mount;

means to communicate electrical power in said wires to an electrical component attached to said component mount;

a bolt communicating though said top wall and said bottom wall, said bolt having a head portion communicating in cooperative engagement with said bottom wall and a threaded portion extending through said top wall;

a spacer of determined length situated on said bolt in between said top wall and said bottom wall;

said threaded portion engageable with threads in said top wall thereby biasing said top wall and said bottom wall toward said center axis of said support beam when said bolt is rotated, said biasing ceasing when said spacer contacts said top wall and said bottom wall; and whereby said support beam when in a suspended position over a stage or similar venue, provides both a support for said electrical component and a conduit for the electrical supply or control wires for said electrical component and said removable sidewall is removable to provide access to said conduit while said support beam and said electrical component remain attached and in said suspended position.

9. The structural truss system as described in claim 8, wherein said bolt also provides an attachment point for to a mount to suspend said support beam in the air in a mounted position.

* * * * *